United States Patent [19]

Grunert et al.

[11] 4,302,650

[45] Nov. 24, 1981

[54] CIRCUIT INTERRUPTER WITH OPTICAL INDICATOR

[75] Inventors: Kurt A. Grunert; John J. Henwood; Birch L. DeVault, all of Beaver, Pa.

[73] Assignee: Westinghouse Electric Corp., Pittsburgh, Pa.

[21] Appl. No.: 155,808

[22] Filed: May 30, 1980

[51] Int. Cl.[3] ..... H01H 9/00

[52] U.S. Cl. ..... 200/308; 116/279

[58] Field of Search ..... 200/308, 56 R, 56 A, 200/311; 116/279

[56] References Cited

U.S. PATENT DOCUMENTS

| | | | |
|---|---|---|---|
| 3,501,717 | 3/1970 | Schubring et al. | 200/308 |
| 4,044,213 | 8/1977 | Kinney | 200/308 |
| 4,052,954 | 10/1977 | Roy | 200/308 |

FOREIGN PATENT DOCUMENTS

| | | | |
|---|---|---|---|
| 2032839 | 3/1979 | Fed. Rep. of Germany | 116/279 |

*Primary Examiner*—Willis Little

*Attorney, Agent, or Firm*—L. P. Johns

[57] ABSTRACT

A circuit interrupter with an optical indicator characterized by a housing, a stationary contact structure within the housing, a movable contact carrier structure within the housing and movable between open and closed positions relative to the stationary contact carrier, said carrier structure also being movable between remote and proximate positions of the lens, indicator means for observing the position of said carrier structure and including a lens in the housing and directed to said carrier structure, indicia on the surface of said carrier structure facing the lens and having two indicia portions, and the lens showing different indicia portions when the carrier structure is in remote and proximate positions, thereby indicating to an observer whether the circuit interrupter is in the open or closed circuit condition.

11 Claims, 5 Drawing Figures

CIRCUIT INTERRUPTER WITH OPTICAL INDICATOR

BACKGROUND OF THE INVENTION

1. Field of the Invention

This invention relates to a circuit interrupter and, more particularly, it pertains to an electric contactor having a controller optical indicator.

2. Description of the Prior Art

In the past a visual indicator has been used generally on motor controllers to establish whether the controller is in the open or closed condition. For that purpose a moving crossbar assembly on the unit has been used as the indication means. However, a disadvantage of directly using the moving crossbar assembly is that the crossbar may be manually altered or jammed.

SUMMARY OF THE INVENTION

It has been found in accordance with this invention that the foregoing disadvantage may be overcome by providing a circuit interrupter having an optical indicator, comprising a housing, a stationary contact structure within the housing, a movable contact carrier structure within the housing and movable between open and closed positions relative to the stationary contact structure, indicator means for observing the position of said contact structure and including a lens in the housing and directed to said carrier structure, said contact structure when moved being movable between remote and proximate positions of the lens, indicia on the surface of said carrier structure facing the lens and having two indicia portions, and different indicia portions being observable through the lens when said carrier structure is in the remote and proximate positions.

The advantage of the device of this invention is that it provides an optical system for indicating the open or closed state of a motor controller while maintaining the security of the actuating mechanism.

DESCRIPTION OF THE PREFERRED EMBODIMENTS

Figure 1:
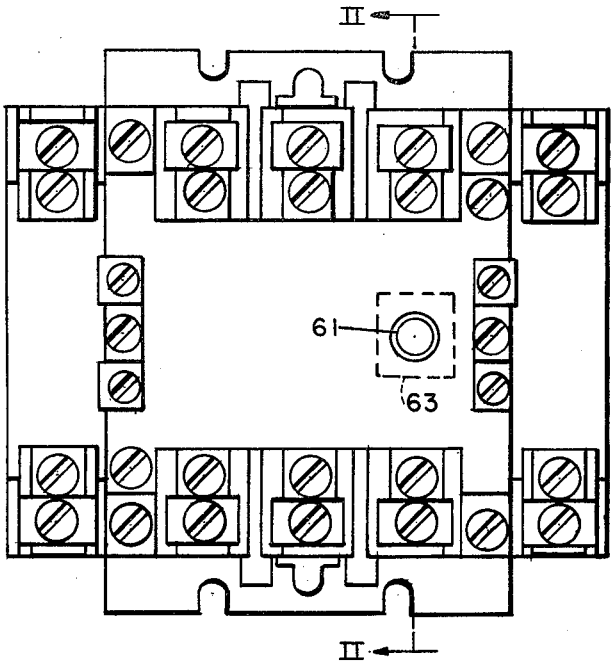
FIG. 1 is a plan view of a contactor.
Figure 2:
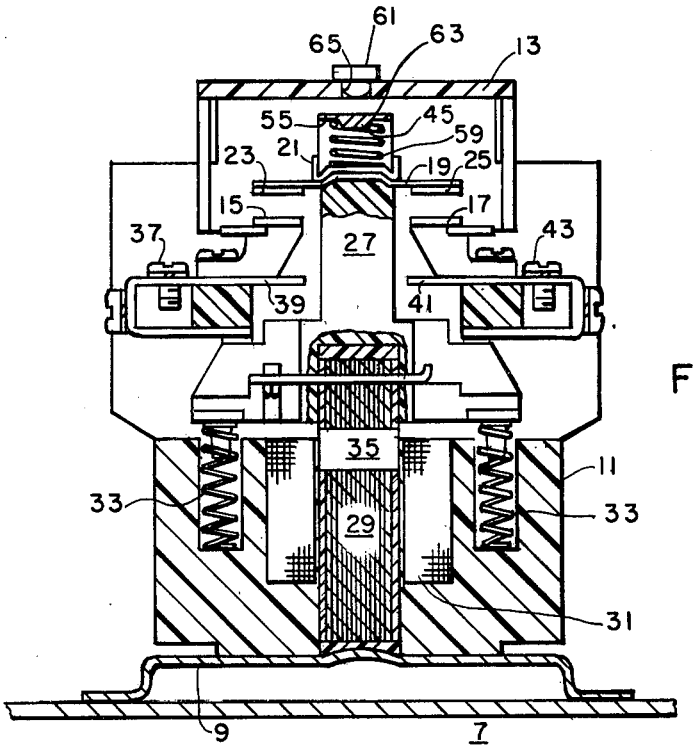
FIG. 2 is a vertical sectional view taken on the line II—II of FIG. 1 and showing the contactor in the normally open condition.

In FIG. 2 a circuit interrupter or contactor is generally indicated at 7 and it comprises a base 9, a housing 11, and a housing cover 13 which cover, like the housing, is comprised of electrically insulating material. The contactor 7 also comprises operating parts including a stationary contact structure having spaced stationary contacts 15, 17, a movable contact carrier structure 21 which includes movable contacts 23, 25, an insulating carrier 27, and electromagnetic means associated with the carrier for moving the carrier vertically and including a core 29 and a coil 31. Springs 33 bias the movable contact carrier structure in the upper position (FIG. 2) with the movable contacts 23, 25 open with respect to the stationary contacts 15, 17.

The contactor 7 is a three-pole contactor and in construction and operation is generally similar to that disclosed in U.S. Pat. No. 3,602,850, for which reason an abbreviated description of the contactor is set forth herein. Suffice it to say, when the coil 31 is energized, the core 29 attracts an armature 35 on the lower end of the carrier 27 against the pressure of the springs 33 to lower the movable contacts 23, 25 onto the corresponding stationary contacts 15, 17. With the contactor in the closed circuit position through the contactor extends from a terminal connector 37 through terminal conductor 39, and contacts 15, 23. The circuit continues through the contact carrier 19 on which the movable contacts 23, 25 are mounted, through the stationary contact 17, and a terminal conductor 41 to a terminal connector 43.

Figure 5:
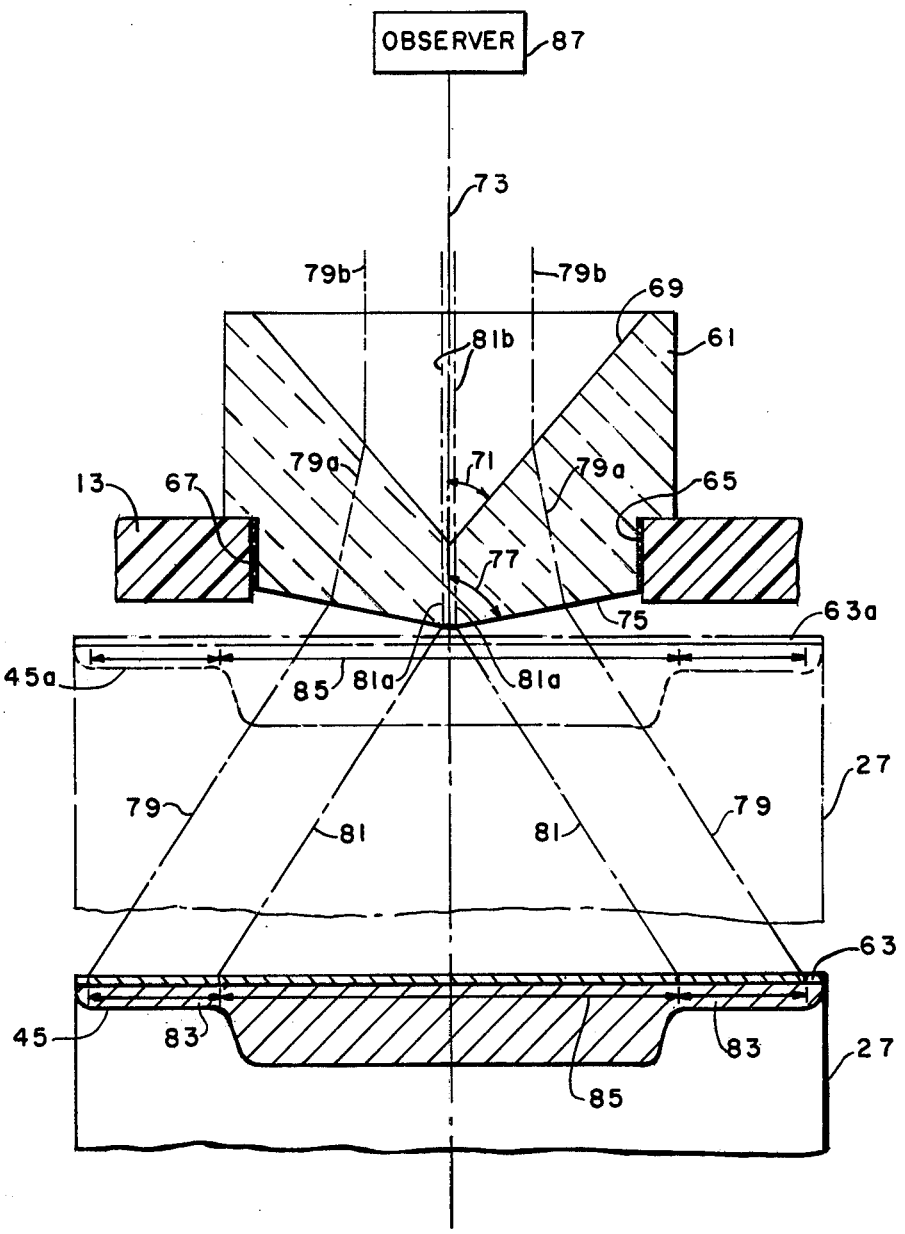
FIG. 5 is an enlarged vertical sectional view taken through the lens and showing the relative positions of the upper end of the carrier structure in the remote and proximate positions of the lens.

In the closed position of the contactor 7 an upper end portion 45 of the carrier 27 is in a lower or remote position (FIG. 5) with respect to the cover 13. When the circuit is open, the upper end portion 45 is in a position proximate to the cover 13 (FIG. 2) and as shown in broken line position **45*a* (FIG. 5**).

Figure 3:
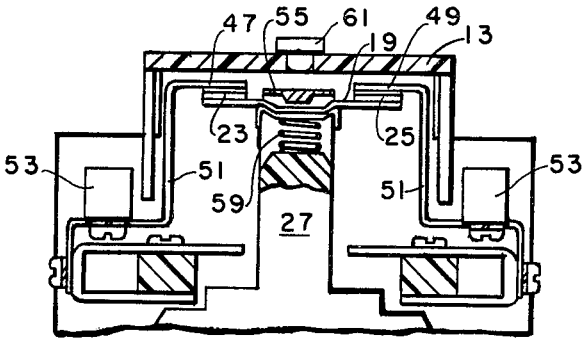
FIG. 3 is a fragmentary view of a contactor similar to that of FIG. 2 in which the contactor is in the normally closed condition.

In the embodiment of the contactor shown in FIG. 2 the contactor is normally opened due to the springs 33 when the coil 31 is deenergized. However, the contactor 7 may be converted to a normally closed device, such as shown in FIG. 3, in which stationary contacts 47, 49 are disposed on similar conductors 51 which extend from similar terminal connectors 53 on opposite sides of the carrier 27. The assembly of the movable contacts 23, 25 and the contact carrier 19 are inverted within an opening 55 in the upper end portion 45 so that the movable contacts face and engage the corresponding stationary contacts 47, 49. In either the normally open condition (FIG. 2), or the normally closed condition (FIG. 3) of the contactor 7, the spring 59 retains the contact carrier 19 in the positions shown to enable yielding engagement between the stationary and movable contacts.

Figure 4:
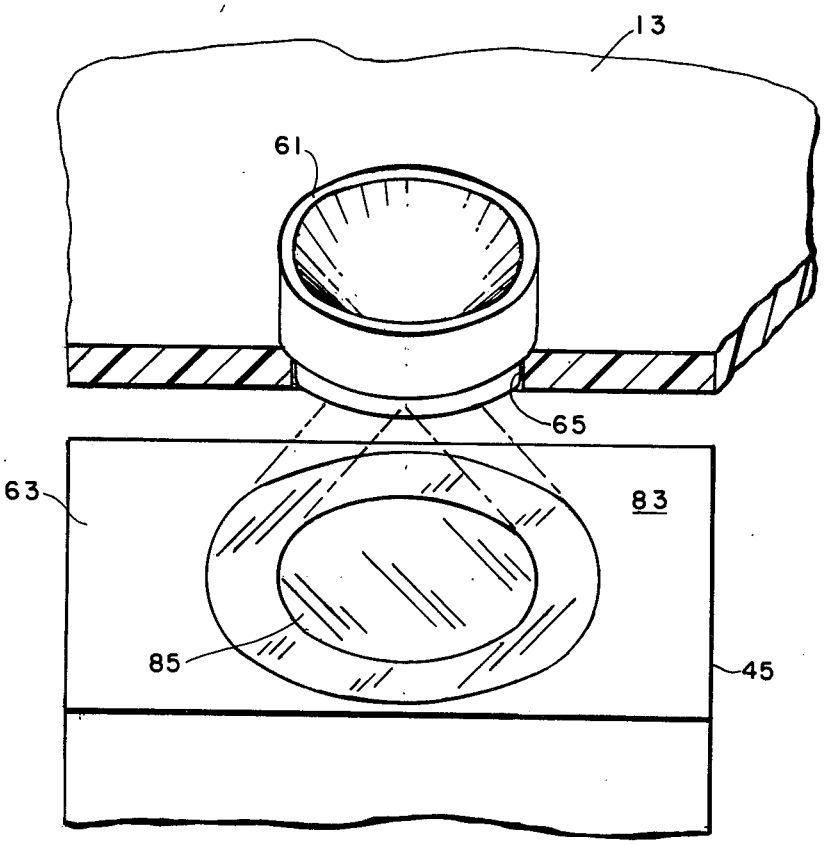
FIG. 4 is an enlarged isometric view showing the relative positions of the lens and an indicia on the top surface of the carrier structure.

In accordance with this invention indicator means for observing the position of the movable contact carrier structure 21 are provided on the contactor 7. The indicator means comprises a lens 61 (FIG. 4) and an indicia 63. The lens 61 is mounted in a hole 65 in the cover 13 where the lens is retained in place in a suitable manner, such as by an adhesive glue or cement 67. The lens 61 (FIG. 5) is a diverging lens of the convexoconcave type and includes a conical surface 69, the surface angle of which is inclined at an angle 71 of about 40° to a longitudinal axis 73 extending through the lens. A lens surface 75 is also conical and extends at an angle 77 of about 80° to the longitudinal axis 73. Manifestly, these angles 71 and 77 are dependent upon the distance of travel of the carrier 27 so that if a greater distance of travel than that disclosed were involved, the angle 77 would be less, and vice versa.

The indicia 63 is preferably a printed marking or decalcomania of a decorative picture or design printed on prepared paper and is secured to the upper surface of the upper end portion 45 of the carrier 27. When the carrier 27 is in the lower or remote position from the lens 61, a peripheral portion of the indicia 63 is seen through the lens. When the carrier 27 is in the elevated or proximate (broken line) position (FIG. 5), a central portion of the indicia 63 is seen through the lens. More particularly, incident light rays 79, 81 extend from a peripheral area (indicated by arrows 83) which is circular around a central area (arrow 85). Inasmuch as the conically shaped incident light rays 81 extend to the center of the lens surface 75, the central area 85 is excluded from vision. Accordingly, incident light rays 79, 81 are refracted at the lens surface 75 as refracted ray portions 79*a*, 81*a* which, in turn, are emitted from the conical surface 69 as emergent light rays 79*b*, 81*b* as viewed by an observer 87.

When the carrier 27 is in the upper or proximate position to the lens 61, the central area 85 is substantially coextensive with the hole 65 so that all incident light rays 79, 81 emanate from the central area. Thus, in the upper position of the carrier 27 the peripheral area 83 is excluded. Where the indicia 63 includes peripheral and central areas 83, 85 which are different, it is readily evident to an observer 87 that the carrier 27 is in the position corresponding to the pattern seen in lens 61. For example, where the surrounding area 83 is one solid color, such as orange, and the central area 85 is another solid color, such as green, an observor 87 can determine the position of the carrier 27 and whether the contactor 7 is in the open or closed position, depending upon whether the contactor is normally open or normally closed.

In conclusion, the device of this invention provides certain advantages not inherent in contactors not having an optical indicator including greater safety, because current carrying parts are isolated from operating personnel, positive color identification of on or off positions, and isolation of the observor from mechanically operating parts.

What is claimed is:

1. A circuit interrupter comprising a housing, a stationary contact structure within the housing, a movable contact carrier structure within the housing and movable between open and closed positions relative to the stationary contact structure, indicator means for observing the position of said carrier structure and including a lens in the housing and directed to said carrier structure, said carrier structure when moved being movable between remote and proximate positions of the lens, indicia on a surface of said carrier structure facing the lens and having two indicia portions, one indicia portion being observable through the lens when said carrier structure is in the remove position, and the other indicia portion being observable when the carrier structure is in proximate positions.

2. The interrupter of claim 1 in which the lens surface is such that incident light rays entering the lens emante from different portions of the indicia when said carrier structure is remote and proximate to the lens.

3. The interrupter of claim 2 in which the lens is a diverging lens and includes a convex surface facing the carrier structure and a concave-conical surface on the surface opposite the carrier structure.

4. The interrupter of claim 3 in which the convex surface is disposed at an angle of approximately 80° degrees to a longitudinal axis through the lens.

5. The interrupter of claim 3 in which the concave-conical surface is disposed at an angle of approximately 40 degrees to the longitudinal axis through the lens.

6. The interrupter of claim 5 in which the indicia comprises a background of one color and a central mark of a different color.

7. The interrupter of claim 6 in which the convex surface receives incident light rays from the peripheral area of the indicia when the carrier structure is in the remote position.

8. The interrupter of claim 7 in which the convex surface receives incident light rays from the central portion of the indicia when the carrier structure is in the proximate position.

9. The interrupter of claim 6 in which the background color is evident in the lens when the carrier structure is in the remote position and the central mark only is evident when the carrier structure is in the proximate position.

10. The interrupter of claim 8 in which the central mark has a size approximately to that of the convex surface whereby the central mark dominates the emerging image from the lens.

11. The interrupter of claim 7 in which the background portion of the indicia emerges from the lens when the carrier structure is in the remote position.

* * * * *